US012613060B2

(12) United States Patent
Poulos et al.

(10) Patent No.: US 12,613,060 B2
(45) Date of Patent: Apr. 28, 2026

(54) WEARABLE COOLING/HEATING SYSTEM

(71) Applicant: WG Products LLC, Chicago, IL (US)

(72) Inventors: James Poulos, Northbrook, IL (US); Peter F. Andreou, Northbrook, IL (US); Katelyn Poulos, Northbrook, IL (US)

(73) Assignee: WG Products LLC, Chicago, IL (US)

( * ) Notice: Subject to any disclaimer, the term of this patent is extended or adjusted under 35 U.S.C. 154(b) by 223 days.

(21) Appl. No.: 18/216,306

(22) Filed: Jun. 29, 2023

(65) Prior Publication Data

US 2023/0349619 A1 Nov. 2, 2023

Related U.S. Application Data

(63) Continuation-in-part of application No. 17/733,060, filed on Apr. 29, 2022, now Pat. No. 12,000,652.
(Continued)

(51) Int. Cl.
*A41D 23/00* (2006.01)
*D03D 1/04* (2006.01)
*F25D 3/06* (2006.01)

(52) U.S. Cl.
CPC ..... *F25D 3/06* (2013.01); *D03D 1/04* (2013.01); *A41D 2023/002* (2013.01);
(Continued)

(58) Field of Classification Search
CPC ..... F25D 2400/26; A41D 2400/46; A41D 13/0053; A41D 13/0056; A41D 13/0058;
(Continued)

(56) References Cited

U.S. PATENT DOCUMENTS 4,641,655 A 2/1987 Abt
4,805,619 A 2/1989 Swearingen
(Continued)

FOREIGN PATENT DOCUMENTS

CN 307248901 4/2022
CN 308372338 12/2023
(Continued)

OTHER PUBLICATIONS https://www.sciencedirect.com/science/article/pii/B9781845695392500028, "Properties of fibers and fabrics that contribute to human comfort", S.A. Hosseini Ravandi and M. Valizadeh. (Year: 2011).*
(Continued)

*Primary Examiner* — Scott T Mcnurlen
(74) *Attorney, Agent, or Firm* — Banner & Witcoff, Ltd.

(57) ABSTRACT

An apparatus comprises first and second fabric layers having corresponding and aligned elongated rectangular sections, which are stitched together at one or more periphery seams. A water-permeable compartment is located between the first and second elongated rectangular sections at the respective middle portions the first and second fabric layers. The water-permeable compartment has an elongated rectangular topside section and an elongated rectangular underside section, each having a length that is less than the length of the elongated rectangular sections of the first and second fabric layers. The second fabric layer and water-permeable compartment collectively define an opening at the middle portion of the second fabric layer, wherein the opening is configured to receive a cooling medium or a heating medium. The apparatus provides the option of whether to wet the middle portion of the second fabric layer that is in contact with the neck of a user.

22 Claims, 11 Drawing Sheets

Related U.S. Application Data

(60) Provisional application No. 63/181,710, filed on Apr. 29, 2021.

(52) U.S. Cl.
CPC ..... *D10B 2201/02* (2013.01); *D10B 2201/24* (2013.01); *D10B 2331/02* (2013.01); *D10B 2331/04* (2013.01); *D10B 2401/00* (2013.01); *F25D 2303/0831* (2013.01); *F25D 2400/26* (2013.01)

(58) Field of Classification Search
CPC ..... A41D 2023/002; A41D 20/005; A41D 2023/004; A41D 27/20; A41D 27/204; A41D 2300/50; A41D 23/00; A45F 2003/166; A45F 3/16; A45F 2200/0583; A45F 3/20; A45F 3/166
USPC ..... 2/207, 247–248
See application file for complete search history.

(56) References Cited

U.S. PATENT DOCUMENTS

| | | | | |
|---|---|---|---|---|
| 4,832,030 | A | 5/1989 | De Canto | |
| 5,072,598 | A | 12/1991 | Dibrell | |
| 5,197,292 | A | 3/1993 | McPherson | |
| 5,507,793 | A * | 4/1996 | Hodges | A61F 7/02 607/114 |
| 5,735,889 | A | 4/1998 | Burkett et al. | |
| 5,785,980 | A | 7/1998 | Mathewson | |
| 5,802,613 | A * | 9/1998 | Marshall | A41D 23/00 2/144 |
| 6,481,021 | B2 | 11/2002 | Spell | |
| 6,581,811 | B1 | 6/2003 | Schillaci | |
| 7,043,765 | B1 | 5/2006 | Otsubo | |
| D602,228 | S | 10/2009 | Pritchett | |
| D650,085 | S | 12/2011 | Rucker et al. | |
| D650,148 | S | 12/2011 | Sanders et al. | |
| 8,292,936 | B2 | 10/2012 | Jung | |
| 8,322,156 | B2 | 12/2012 | Searle | |
| D770,813 | S | 11/2016 | Furstenburg et al. | |
| D821,597 | S | 6/2018 | Martinez | |
| D845,582 | S * | 4/2019 | Carzola | D2/600 |
| 10,463,139 | B2 | 11/2019 | Sola et al. | |
| 10,499,697 | B1 * | 12/2019 | Posta | A41D 27/201 |
| D873,585 | S | 1/2020 | Turbeville et al. | |
| 10,709,184 | B2 | 7/2020 | Moore | |
| 11,278,065 | B2 | 3/2022 | Hubbs | |
| 11,751,613 | B1 | 9/2023 | Sartelli | |
| D1,073,248 | S | 5/2025 | Bradley | |
| 12,295,436 | B2 | 5/2025 | Mastel | |
| 2002/0052566 | A1 | 5/2002 | Sequeira | |
| 2004/0128747 | A1 | 7/2004 | Bumbarger et al. | |
| 2006/0010569 | A1 * | 1/2006 | Tawfik | A41D 23/00 2/207 |
| 2006/0065201 | A1 | 3/2006 | Cogliano et al. | |
| 2007/0225782 | A1 | 9/2007 | Taylor | |
| 2010/0125931 | A1 * | 5/2010 | Arakelian | A41D 23/00 607/109 |
| 2012/0204323 | A1 * | 8/2012 | Park | A41D 23/00 2/202 |
| 2013/0073016 | A1 | 3/2013 | Matsuo | |
| 2013/0284762 | A1 | 10/2013 | Voss | |
| 2016/0270464 | A1 | 9/2016 | Nigri | |
| 2017/0129687 | A1 | 5/2017 | Atkins | |
| 2017/0266038 | A1 | 9/2017 | Peavy et al. | |
| 2018/0243127 | A1 | 8/2018 | Chavarry et al. | |
| 2020/0196687 | A1 | 6/2020 | Hubbs | |
| 2020/0329795 | A1 * | 10/2020 | Rhodes | A41D 13/0058 |

FOREIGN PATENT DOCUMENTS

| | | | |
|---|---|---|---|
| KR | 300626817 | | 12/2011 |
| KR | 20140141161 | A | 12/2014 |
| KR | 101977325 | B1 | 5/2019 |
| WO | 1991016022 | A1 | 10/1991 |
| WO | 2000021473 | A1 | 4/2000 |
| WO | 2012083477 | A1 | 6/2012 |
| WO | D082932 | | 3/2014 |
| WO | 2018165696 | A1 | 9/2018 |

OTHER PUBLICATIONS

Amazon, "Bare Neckd," Bare Neckd Ice Cooling Towels with Insulated Ice Pockets at <https://www.amazon.com/Bare-Neckd-Real-Cooling-Towel/dp/B07CW51MTF?th=1> Feb. 15, 2021.
Walmart, "Cool Relief," Cool Relief at <https://www.walmart.com/ip/Refreezable-Ice-Bandana-Head-Wrap-Neck-Ice-Cooling-Scarf-Ice-Cooling-Headband-Neck-Ice-Pack/924069495> Feb. 15, 2021.
Xuhal 6 Pieces Cooling Neck Wraps, [online]; [published to the internet on Jan. 28, 2023]; [retrieved from the internet on Jul. 23, 2025]; URL: https://www.amazon.com/dp/BO BT9Q F M53? encoding= UTF8&ref=cm_sw_r cp _ud_dp_2 P4 E0 RW4 E D5X36VS ESYC&ref_ =cm_sw_r_cp_ud_dp_2P4 . . . (7 pages). (Year: 2023).
Action Heat AA Battery Heated Scarf, [online]; [published to the internet on Sep. 2, 2020]; [retrieved from the internet on Jul. 23, 2025]; URL:https://www.amazon.com/ActionHeat-Battery-Heated-Heating-BuilUdp/B08HB62LKM. (6 pages). (Year: 2020).
Cool Kids™ Cool58® Neck Wrap, [online]; [date published to the internet unknown]; [retrieved from the internet on Jul. 23, 2025]; URL:https://www.polarproducts.com/polarshop/pc/Cool-Kids-Neck-Wrap-with-Cool58-Pack-p1933.htm. (2 pages). (Year: 2025).

* cited by examiner

WEARABLE COOLING/HEATING SYSTEM

CROSS-REFERENCE TO RELATED APPLICATION

This application is a continuation-in-part of prior U.S. application Ser. No. 17/733,060, filed Apr. 29, 2022, which claims priority to U.S. Provisional Application No. 63/181,710 filed Apr. 29, 2021, which are hereby incorporated by reference in their entirety.

TECHNICAL FIELD

This invention relates generally to a wearable cooling/heating system.

BACKGROUND

Personal hydration devices have been developed that can be worn by users. Some personal hydration devices have been designed to be worn around a user's neck. For example, Atkins Pub. No. 2017/0129687 discloses a beverage insulating sleeve that can hold two portable beverage containers, cold or hot packs and personal belongings around the back of the neck of a user.

Moore U.S. Pat. No. 10,709,184 discloses a hydration scarf to be worn around the neck to allow consumption of a beverage.

A disadvantage of the above exemplary conventional devices is that they do not provide the option of whether or not to cool the neck of a user with a cooling medium placed into the device that optionally wets a portion of the device that is in contact with the neck of the user. For example, the above exemplary conventional devices do not optionally allow water from the melting of ice held in such devices to wet a water permeable portion of the device that is in contact with the back and/or sides of the neck and/or collarbone of a user.

SUMMARY

An apparatus or system has now been developed that provides a user the option of whether or not to cool or heat a body part (e.g., a back and/or sides of the neck and/or collarbone) of or clothing (e.g., the back and/or sides of a shirt collar and/or shirt portion adjacent to the collarbone) worn by a user with a cooling or heating medium placed in the apparatus that optionally wets a portion of the apparatus that is in contact with the body part of or clothing worn by a user.

In an aspect, an apparatus comprises first and second fabric layers having corresponding and aligned elongated rectangular sections, which are stitched together at one or more periphery seams. A water-permeable compartment is located between the first and second elongated rectangular sections at the respective middle portions the first and second fabric layers. The water-permeable compartment has an elongated rectangular topside section and an elongated rectangular underside section, each having a length that is less than the length of the elongated rectangular sections of the first and second fabric layers. The second fabric layer and water-permeable compartment may collectively define an opening at the middle portion of the second fabric layer, wherein the opening is configured to receive a cooling medium or a heating medium. The water-permeable compartment is configured to receive a cooling medium or heating medium via the opening. The apparatus provides the option of whether to wet the middle portion of the second fabric layer that is in contact with the body part of or clothing worn by a user, e.g., the back and/or sides of the neck and/or collarbone of a user or the back and/or sides of a collar or shirt portion adjacent the collarbone of a shirt worn by a user.

In an aspect, a wearable cooling/heating system or apparatus is provided that can be worn on the back and sides of a wearer's neck. The apparatus comprises a first fabric layer and a second fabric layer. The first fabric layer has an elongated rectangular section aligned with an elongated rectangular section of the second fabric layer. In an embodiment, the elongated rectangular section of the first fabric layer is stitched to the elongated rectangular section of second fabric layer at one or more periphery seams at or near the respective peripheries of each fabric layer. The apparatus comprises a water-permeable compartment located between the elongated rectangular section of the first fabric layer and the elongated rectangular section of the second fabric layer at a middle portion of the first fabric layer and the second fabric layer. In an embodiment, the water-permeable compartment has an elongated rectangular topside section and an elongated rectangular underside section, each having a length that is less than the length of the elongated rectangular sections of the first and second fabric layers. In an embodiment, the elongated rectangular topside section and elongated underside section of the water-permeable compartment are stitched together at one or more periphery seams at or near the respective peripheries of the elongated rectangular topside section and elongated underside section of the water-permeable compartment. In an embodiment, the one or more periphery seams of the water-permeable compartment coincide or are the same as the one or more periphery seams of the first fabric layer and the second fabric layer.

The second fabric layer defines an opening at a middle portion of the second fabric layer. In an embodiment, the opening is a slot that extends along a width of the elongated rectangular section of the second fabric layer. When the opening is a slot, in an embodiment, the slot is substantially perpendicular to the length of the second fabric layer. The water-permeable compartment can be accessed through the opening defined by the second fabric layer. A cooling medium (e.g., ice, reusable ice pack(s), ice within a water-tight closure bag) or a heating medium (e.g., a warming pack(s)) can be placed into the water-permeable compartment through the opening defined by the second fabric layer. When a user wears at least a part of the middle portion of the second fabric layer in contact with a body part of or clothing worn by a user, e.g., on the back and/or sides of the user's neck, the cooling or heating medium cools or warms the at least one part of the middle portion placed on the body part of or clothing worn by the user. In an embodiment, the first and second end portions of the apparatus can be draped over the front of the user.

In an aspect, the apparatus or system comprises a bag or container. The bag or container may be configured to be inserted into the water-permeable compartment through the opening defined by the second fabric layer. The bag or container may contain the cooling or heating medium. The bag or container can have a water-tight closure that can be opened. When the user wants to wet the water-permeable compartment and wet the portion of the second fabric layer on the back and/or sides of the user's neck, the user can open the water-tight closure of the bag or container to allow cold/cool water or warm water out of the bag or container.

It is an object of the present invention to provide an apparatus that may be easily used to cool the neck of a user with a portion of the apparatus that is wetted by water from melted ice or condensate from ice or a cold pack held within in the apparatus.

These and other objects are set forth in the following description.

BRIEF DESCRIPTION OF THE DRAWINGS

In the detailed description that follows, reference will be made to the following figures.

DETAILED DESCRIPTION

Figure 1:
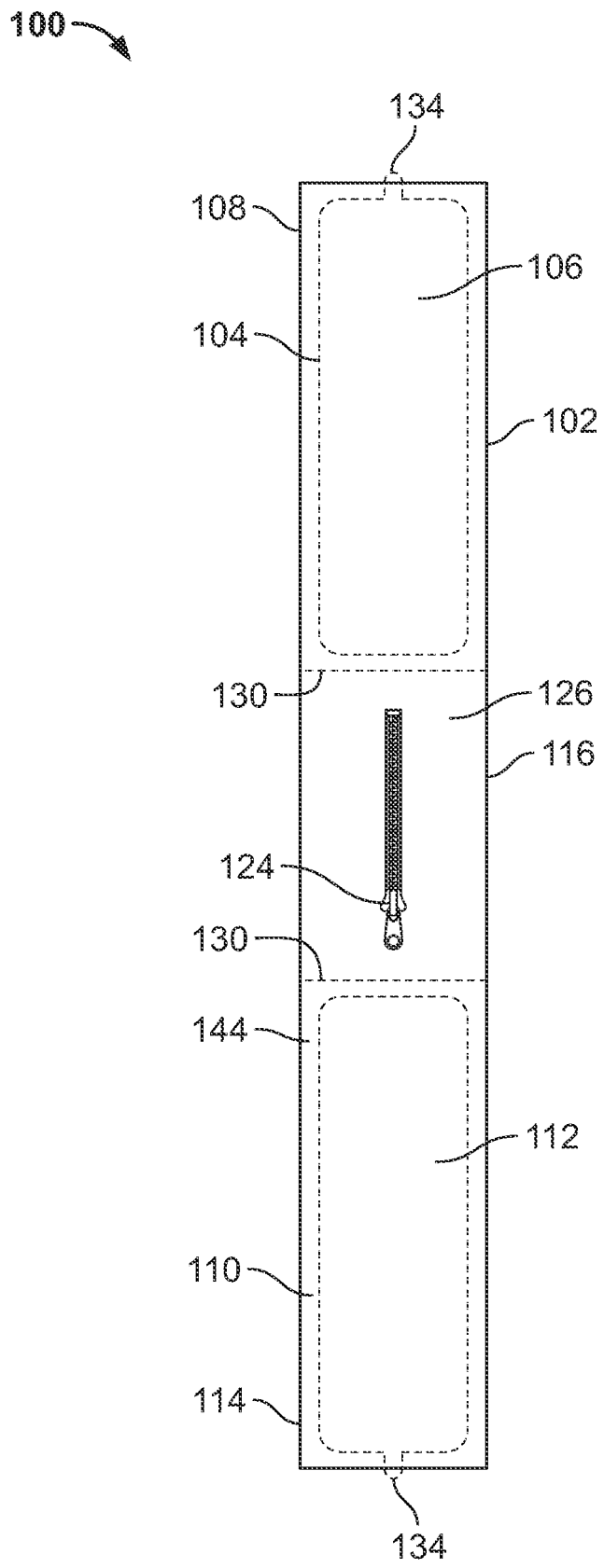
FIG. 1 is a semi-transparent top view showing of an embodiment of the apparatus according to the invention when laid flat, with the topside zipper in the closed position.

In an aspect, a wearable cooling/heating system or apparatus is provided that can be worn on the back and sides of a wearer's neck and/or the collarbone of a wearer. The apparatus comprises a first fabric layer and a second fabric layer. The first fabric layer has an elongated rectangular section aligned with an elongated rectangular section of the second fabric layer. In an embodiment, the elongated rectangular section of the first fabric layer is stitched to the elongated rectangular section of second fabric layer at one or more periphery seams at or near the respective peripheries of each fabric layer. The apparatus comprises a water-permeable compartment located between the elongated rectangular section of the first fabric layer and the elongated rectangular section of the second fabric layer at a middle portion of the first fabric layer and the second fabric layer. In an embodiment, the water-permeable compartment has an elongated rectangular topside section and an elongated rectangular underside section, each having a length that is less than the length of the elongated rectangular sections of the first and second fabric layers. In an embodiment, the elongated rectangular topside section and elongated underside section of the water-permeable compartment are stitched together at one or more periphery seams at or near the respective peripheries of the elongated rectangular topside section and elongated underside section of the water-permeable compartment. In an embodiment, the one or more periphery seams of the water-permeable compartment coincide or are the same as the one or more periphery seams of the first fabric layer and the second fabric layer.

The second fabric layer defines an opening at a middle portion of the apparatus. In an embodiment, the opening is a slot that extends along a width of the elongated rectangular section of the second fabric layer. When the opening is a slot, in an embodiment, the slot is substantially perpendicular to the length of the apparatus. The water-permeable compartment can be accessed through the opening defined by the second fabric layer. A cooling medium (e.g., ice) or a heating medium (e.g., a warming packet) can be placed into the water-permeable compartment through the opening defined by the second fabric layer. When a user wears the apparatus on the back and sides of their neck and/or collarbone, at least a portion of the cooling or heating medium is aligned with the back and/or sides of the wearer's neck and/or collarbone of the wearer. First and second end portions of the apparatus can be draped over the front of the wearer and/or tied and/or attached to each other.

In an aspect, the system comprises a bag or container. The bag or container may be configured to be inserted into the water-permeable compartment through the opening defined by the second fabric layer. The bag or container may contain the cooling or heating medium. The bag or container may have a water-tight closure that can be opened. When the user wants to wet the water-permeable compartment and wet the portion of the second fabric layer in contact with the back and/or sides of the user's neck and/or the collarbone of the user, the user can open the water-tight closure of the bag or container to allow cold/cool water or warm water out of the bag or container.

In an embodiment, the water-permeable compartment comprises a different material than the first fabric layer and the second fabric layer. In embodiment, the first fabric layer comprises the same material or different material than the second fabric layer. In an aspect, the water-permeable compartment has less water permeability than the second fabric layer.

In an aspect, the first fabric layer and/or second fabric layer comprises a material selected from the group consisting of cotton, synthetic material, and combinations thereof. In an aspect, the synthetic material is a microfiber. In an aspect, the first fabric layer and/or second fabric layer comprises a material having a weave selected from the group consisting of terry, waffle, gauze, damask, herringbone, and combinations thereof.

In an aspect, the water-permeable compartment comprises material selected from the group consisting of nylon, rayon, polyester, and combinations thereof.

In an aspect, the opening is a slot that extends along a width of the elongated rectangular section of the second fabric layer. In an embodiment, the slot is perpendicular or substantially perpendicular to the length of the elongated rectangular section of the second fabric layer.

In an aspect, the cooling medium comprises water having a temperature less than ambient air and is selected from the group comprising ice, cold water, cooled water, and combinations thereof.

In an aspect, when the cooling medium is placed into the water-permeable compartment, liquid water will wet the part of the middle portion of the second fabric layer in contact with the neck portion of a user.

In an aspect, when the cooling medium is in a resealable container, the opening defined by the second fabric layer and the water-permeable compartment are each configured to receive the resealable container.

In an aspect, when the seal of the resealable container is opened at least partially, liquid water from the container will wet the water-permeable compartment and wet the part of the middle portion of the second fabric layer in contact with the neck portion of a user.

In an aspect, the cooling medium or heating medium is maintained in a bendable strip of material and the opening defined by the second fabric layer and the water-permeable compartment are each configured to receive the bendable strip of material.

In an embodiment, the slot has a first edge and second edge, wherein the first edge extends over the second edge, the combination of which serves to maintain the cooling or heating medium within the water-permeable compartment as desired. Alternatively, or in addition, in an embodiment, a closure structure, e.g., a button and corresponding button-hole or loop, hooks and loops (e.g., Velcro®), zipper, or male-female snap(s) may be provided at or near the first and second edges of the slot to maintain the cooling or heating medium within the water-permeable compartment as desired.

In an embodiment, the water-permeable compartment has a length that is 20 to 40% less than the length of the elongated rectangular section of the second fabric layer.

In an embodiment, the water-permeable compartment has a length that is 25 to 35% less than the length of the elongated rectangular section of the second fabric layer.

In an embodiment, the apparatus has length of about 40-51 inches and a width of about 5-7 inches. In an embodiment, pockets or pouches are provided near or at least one of the elongated rectangular sections of the second fabric layer and/or the elongated rectangular sections of the first fabric layer. In an embodiment, the pockets or pouches may be about 6-8 inches in length, and a width of about 5-7 inches.

In an embodiment, the cooling medium compartment can hold at least three cups of ice.

Figure 9:
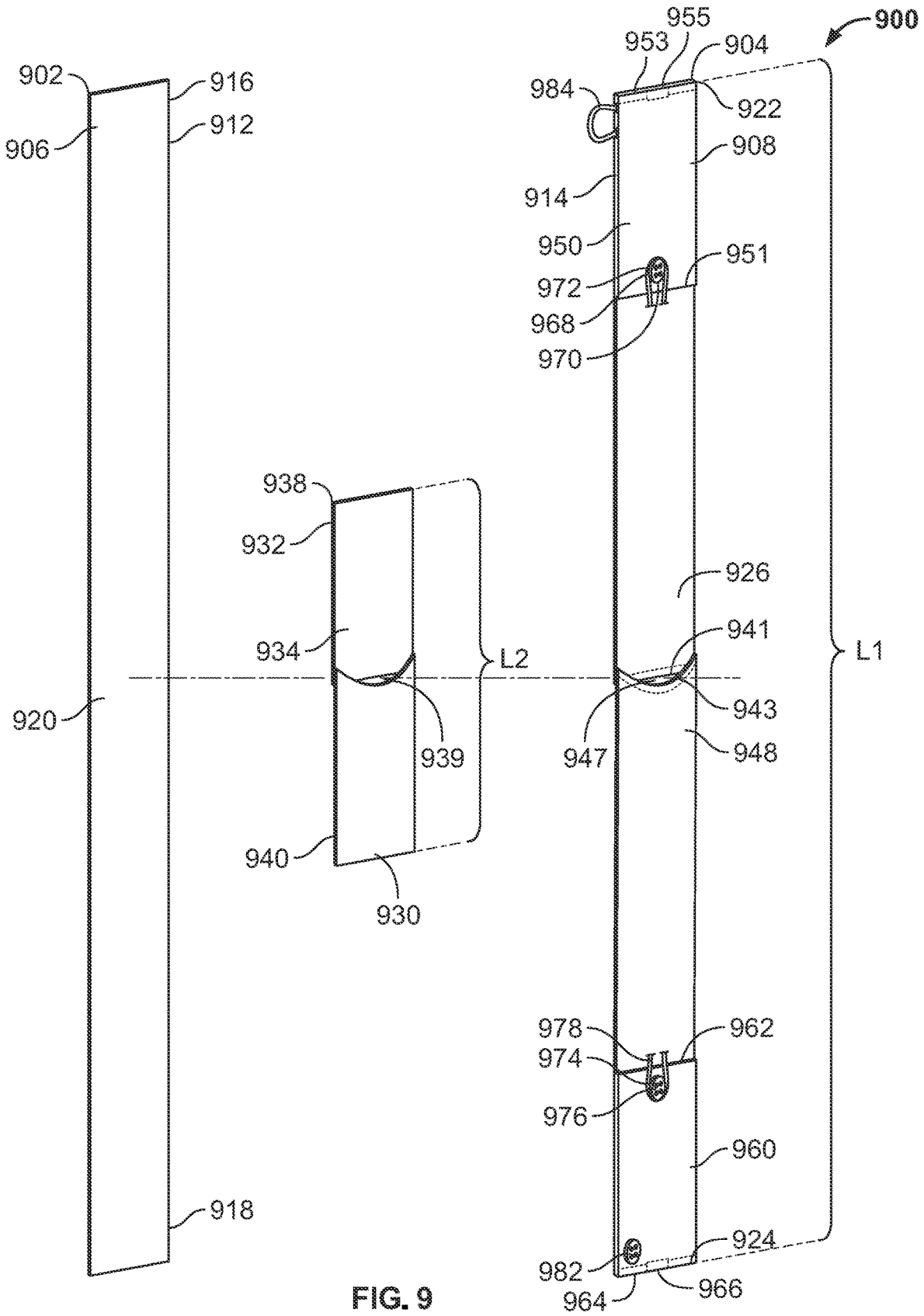
FIG. 9 is a perspective exploded view of an alternative embodiment in accordance with aspects of the disclosure.
Figure 10:
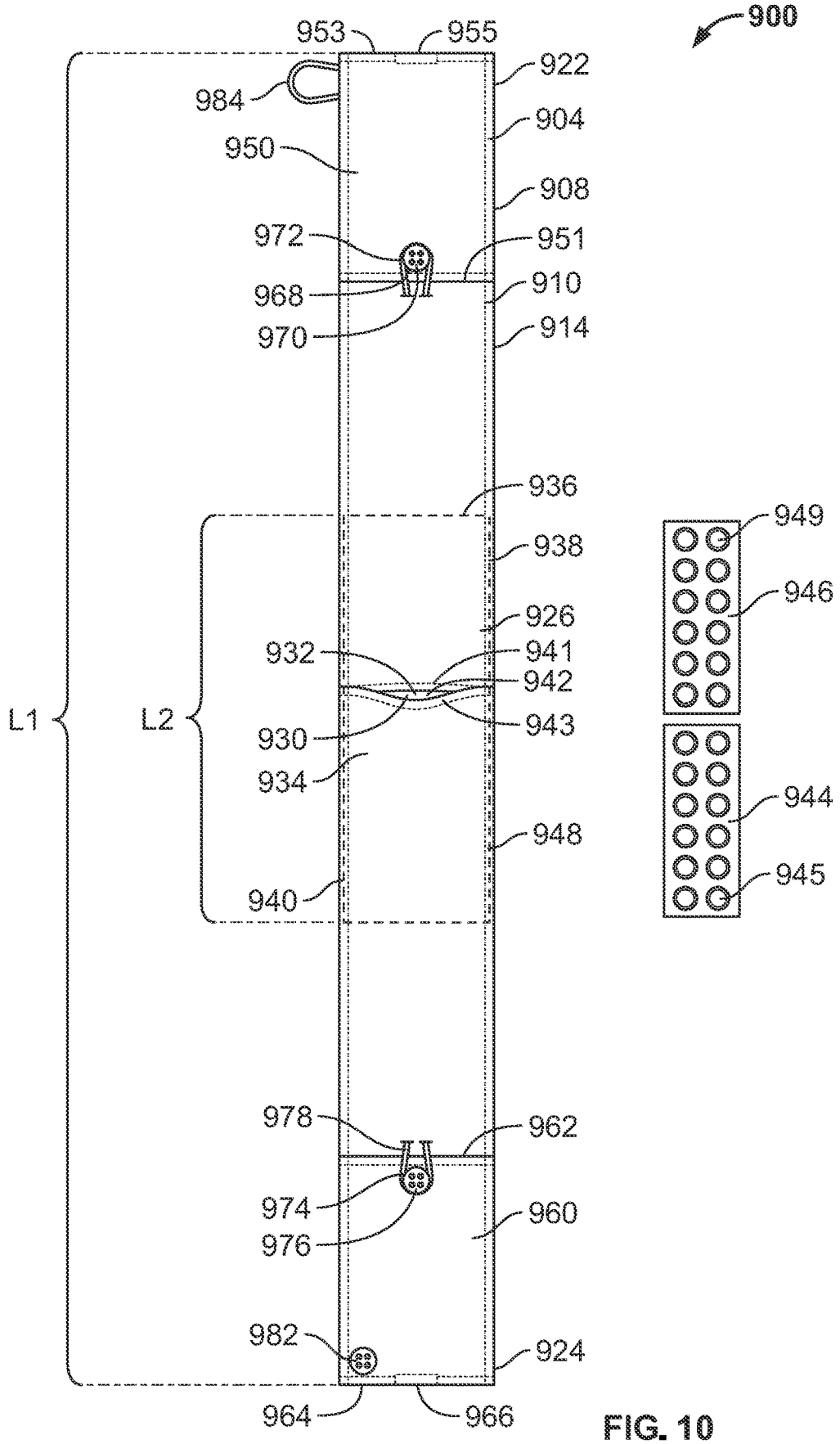
FIG. 10 is a bottom view of the embodiment shown in FIG. 9.
Figure 11:
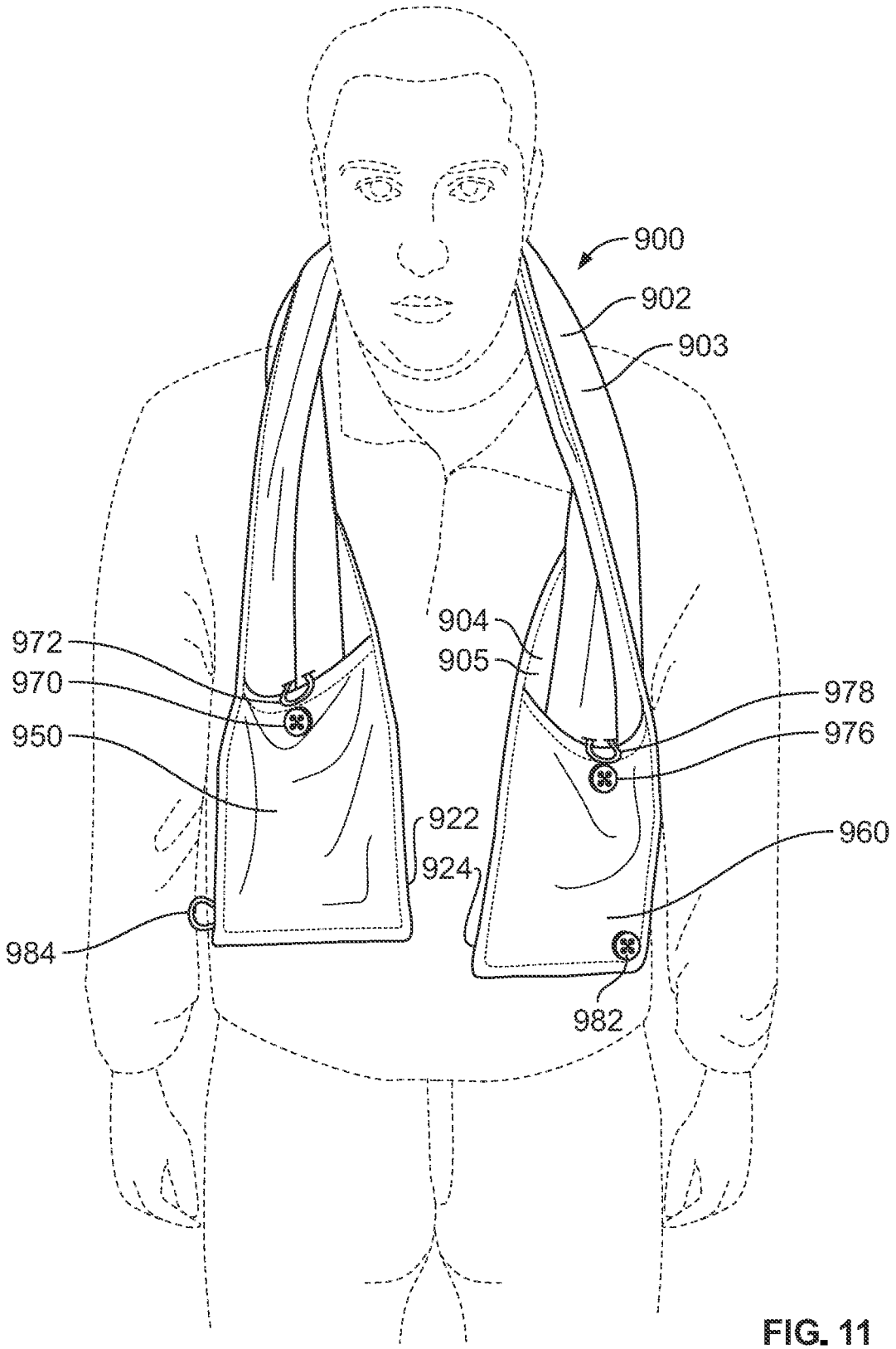
FIG. 11 is a perspective view of the embodiment shown in FIG. 9, showing when worn by a user in accordance with aspects of the disclosure.

FIG. 9 is an exploded view of an embodiment in accordance with aspects of the disclosure. FIG. 10 is a bottom view of the embodiment shown in FIG. 9. FIG. 11 is a perspective view of the embodiment shown in FIG. 9, showing when worn by a user in accordance with aspects of the disclosure.

In reference to FIG. 9 through FIG. 11, apparatus 900 comprises first fabric layer 902 and second fabric layer 904, wherein first fabric layer 902 has elongated rectangular section 906 aligned with elongated rectangular section 908 of second fabric layer 904. Elongated rectangular section 906 of first fabric layer 902 is stitched to elongated rectangular section 908 of second fabric layer 904 at one or more periphery seams 910 at or near the respective peripheries 912, 914 of each fabric layer 902,904. First fabric layer 902 has first end portion 916, second end portion 918, and middle portion 920. Second fabric layer 904 has first end portion 922, second end portion 924, and middle portion 926.

First end portion 916, second end portion 918, and middle portion 920 of first fabric layer 902 respectively correspond to first end portion 922, second end portion 924, and middle portion 926 of second fabric layer 904.

Water-permeable compartment 930 is located between first fabric layer 902 and second fabric layer 904 at middle portion 920 of first fabric layer 902 and corresponding middle portion 926 of the second fabric layer 904. Water-permeable compartment 930 has elongated rectangular topside section 932 and elongated rectangular underside section 934, each having a length L2 that is less than the length L1 of respective elongated rectangular sections 906, 908 of the first and second fabric layers.

Elongated rectangular topside section 932 and elongated underside section 934 of water-permeable compartment 930 are stitched together at one or more periphery seams 936 at or near respective peripheries 938, 940 of elongated rectangular topside section 932 and elongated underside section 934.

Second fabric layer 904 defines opening 947, and water-permeable compartment 930 defines opening 939. Opening 947 of second fabric layer 904 and opening 939 of water-permeable compartment 930 may collectively comprise opening 942 at middle portion 926 of second fabric layer 904. Opening 942 is configured to receive cooling medium 944 or heating medium 946. Cooling medium 944 or heating medium 946 may be reusable for cooling or warming as desired. In an embodiment, cooling medium 944 may comprise reusable cooling sub-packets 945. In an embodiment, heating medium 946 may comprise warming sub-packets 949. Cooling medium 944 or heating medium 946 may comprise a bendable portion or strip of material configured to conform to a body part of a user when placed over that body part. Water-permeable compartment 930 is configured to receive cooling medium 944 or heating medium 946 via opening 942. At least outer surface 948 of middle portion 926 of second fabric layer 904 may be placed on a body part of a user, e.g., the back and/or sides of the neck and/or collarbone of a user. When cooling medium 944 or heating medium 946 is placed into water-permeable compartment 930, and at least outer surface 948 is placed on body part of a user, cooling medium 944 or heating medium will cool or warm that body part of a user by cooling or warming elongated rectangular underside section 934 of water-permeable compartment 930 and outer surface 948.

In an embodiment, opening 947 may have first edge 941 and second edge 943, wherein first edge 941 extends over second edge 943, the combination of which serves to maintain the cooling or heating medium within the water-permeable compartment as desired.

In an embodiment, apparatus 900 may comprise at least one pocket 950 having first end 951 and second end 953. Pocket 950 may be configured to receive one or more personal items, e.g., cell-phone, wallet, keys, cigar(s). At least one pocket 950 may be located on outside surface 905 of second fabric layer 904 at or near one of end portion 922 and/or end portion 924, or closer to middle portion 926 and further away from end portion 922 and/or end portion 924. Alternatively, or in addition, at least one pocket 950 may be located on outside surface 903 of first fabric layer 902 at or near one of end portion 916 or end portion 918, or closer to middle portion 920 and further away from end portion 916 and/or end portion 918. Pocket 950 may be devoid of closure structure or have a closure structure 968, e.g., a button 970 and loop 972 or button-hole configured to receive button 970, hooks and loops (e.g., Velcro®), zipper, or male-female snap(s) at first end 951 of pocket 950. Alternatively, or in addition, pocket 950 may be configured to receive a beverage container (not shown), e.g., a beverage bottle or bladder filled with a beverage. Second end 953 may define optional hole 955. Optional hole 955 may be configured to receive a port of a beverage container (not shown), e.g., a beverage bottle or bladder filled with a beverage.

In an embodiment, apparatus 900 may comprise at least one pouch or beverage compartment 960 having first end 962 and second end 964. Beverage compartment 960 may be configured to receive a beverage container (not shown), e.g., a beverage bottle or bladder filled with a beverage. Second end 964 may define optional hole 966. Optional hole 966 may be configured to receive a port of a beverage container. At least one beverage compartment 960 may be located on outside surface 905 of second fabric layer 904 at or near end portion 922 and/or 924, or closer to middle portion 926 and further away from end portion 922 and/or end portion 924. Alternatively, or in addition, at least beverage compartment 960 may be located on outside surface 903 of first fabric layer 902 at or near end portion 916 and/or end portion 918, or closer to middle portion 920 and further away from end portion 916 and/or end portion 918. Beverage compartment 960 may be devoid of closure structure or have a closure structure 974, e.g., a button 976 and loop 978 or button-hole configured to receive button 976, hooks and loops (e.g., Velcro®), zipper, or male-female snap(s) at first end 962 of beverage compartment 960.

In an embodiment, the first and second ends 916, 918 of first fabric layer and/or first and second ends 922, 924 of second fabric layer may be fastened to each other by fastening structure 980, e.g., a button 982 and loop 984 or button-hole configured to receive button 982, hooks and loops (e.g., Velcro®), zipper, or male-female snap(s). When middle portion 926 of second fabric layer 904 is placed on the back and/or sides of the neck and/or collarbone of a user, and end portions 916, 918, 922, 924 of the first and second fabric layers are placed in front of the user, fastening structure 980 may be used to fasten end portions 916, 918, and/or end portions 922, 924 to each other.

FIG. 11 is a perspective view of the embodiment shown in FIG. 9, showing when worn by a user in accordance with aspects of the disclosure. As shown in FIG. 11, ends 916, 918 and ends 922, 924 are twisted 180 degrees to show that when ends 922, 924 are not twisted 180 degrees, those ends face the user wearing apparatus 900. Optional holes 955 and 966 as shown in FIGS. 9-10 are not shown in FIG. 11.

ELEMENTS FOR FIGS. 9-11

900—apparatus
902—first fabric layer
903—outside surface of first fabric layer 902
904—second fabric layer
905—outside surface of second fabric layer 904
906—elongated rectangular section of first fabric layer
908—elongated rectangular section of second fabric layer 904
910—stitched periphery seam
912—periphery of first fabric layer
914—periphery of second fabric layer
916—first end portion of first fabric layer
918—second end portion of first fabric layer
920—middle portion of first fabric layer
922—first end portion of second fabric layer
924—second end portion of second fabric layer
926—middle portion of second fabric layer
930—water-permeable compartment
932—elongated rectangular topside section of water-permeable compartment 930
934—elongated rectangular underside section of water-permeable compartment 930
L2—length of elongated rectangular topside and underside sections 932, 934
L1—length of elongated rectangular sections 906, 908 of first and second fabric layers
936—stitched periphery seam
938—periphery of elongated rectangular topside section 932
939—opening defined by water permeable compartment 930
940—periphery of elongated rectangular underside section 934
941—first edge of opening 942
942—opening configured to receive cooling medium 944 or heating medium 946
943—second edge of opening 942
944—cooling medium
945—cooling subpacket
946—heating medium
947—opening defined by second fabric layer 904
948—outer surface of middle portion 926
949—warming subpacket
950—pocket
951—first end of pocket 950
953—second end of pocket 950
955—optional hole for port of beverage bottle or bladder
960—beverage compartment
962—first end of beverage compartment
964—second end of beverage compartment
966—optional hole for port of beverage bottle or bladder
968—closure structure of pocket 950
970—button
972—loop or button-hole
974—closure structure of beverage compartment 960
976—button
978—loop or button-hole
980—fastening structure (to fasten 916, 918, and/or 922, 924 to each other)
982—button
984—loop or button-hole Alternative embodiments are shown in FIG. 1 through FIG. 8. In an alternative embodiment, an apparatus comprises a holding tube. The holding tube comprises at least a first compartment configured to hold a first beverage container at a first section of the holding tube, a second compartment configured to hold a second beverage container at a second section of the holding tube, and a third compartment configured to hold a cooling medium. The third compartment, also referred herein as the cooling medium compartment or cooling medium reservoir, is positioned between the first and second compartments. The apparatus comprises a water permeable membrane located below an underside of the cooling medium compartment.

The cooling medium compartment comprises a topside zipper located on the topside of the cooling medium compartment, and an underside zipper located on the underside of the cooling medium compartment. When the topside zipper is zipped to the closed position, there is no access from outside the holding tube to a space defined by the cooling medium compartment. When the topside zipper is unzipped to at least a partially open position, access is allowed from outside the holding tube to the space defined by the cooling medium compartment. The topside zipper allows a user to unzip the topside zipper to insert a cooling medium into the cooling medium compartment, and then zip the topside zipper to prevent the cooling medium from leaving the cooling medium compartment through the topside zipper.

A user can access the underside zipper when the topside zipper is unzipped to at least a partially open position. When the underside zipper is zipped to the closed position, there is no opening between the cooling medium compartment and the permeable membrane. When the underside zipper is unzipped to at least a partially open position, there is an opening between the cooling medium compartment and the permeable membrane to allow water to move from the cooling medium compartment to the permeable membrane. The permeable membrane is configured to allow a cooling medium, e.g., water formed from the melting of ice or condensate from a cold pack in the cooling medium compartment, to wet and permeate through the permeable membrane. In an embodiment, the holding tube is made of a water repelling fabric, and the permeable membrane is made of a water permeable fabric that are comfortable to the skin of a user. The holding tube can form a U-shape, wherein the permeable membrane can be placed on the back and/or sides of the neck and/or collarbone of user, and the first and second compartments positioned to rest on the left and right front chest or torso of the user.

Thus, a user can wear the apparatus and the user can opt to unzip the underside zipper to allow water from the cooling medium compartment to wet and permeate through the permeable membrane to cool the back and/or sides of the user's neck and/or collarbone of the user.

In an embodiment, the apparatus further comprises a towel tube, wherein the holding tube and the permeable membrane are located within the towel tube. The towel tube is water absorbent. The towel tube comprises a towel having lateral sides and longitudinal sides, wherein the longitudinal sides are joined together. In this embodiment, the towel tube may fastened to the holding tube, and together can form a U-shape, wherein the bite portion of the U-shape has the cooling membrane compartment and permeable membrane. The bite portion of the U-shape can be placed on the back and sides of the neck and/or collarbone of a user, and the first and second compartments positioned to rest on the left and right front chest or torso of the user. The permeable membrane is configured to allow a cooling medium, e.g., water formed from the melting of ice or condensate from a cold pack in the cooling medium compartment, to wet and permeate through the permeable membrane, and then wet the portion of the towel tube resting on the back and sides of the user's neck and/or collarbone of the user.

In an alternative embodiment, the apparatus comprises a water permeable membrane that is a tube or bag that may share a top zipper with the towel tube at the bite or middle portion of the towel tube. The permeable membrane bag may be affixed to the towel tube, for example by stitching, or snaps, buttons, or hooks and loops. The top zipper may be affixed to the towel tube before the towel is rolled to form the towel tube. In an aspect, the cooling medium compartment may also share the top zipper with the permeable membrane bag and the towel tube. In this embodiment, the cooling medium compartment is within the permeable membrane bag or tube, the combination of which may be characterized as a "bag within a bag." In this embodiment, there is no holding tube. In this embodiment, when the underside zipper of the cooling medium compartment is at least partially unzipped, water from cooling medium compartment can wet and permeate through the permeable membrane bag to cool the user's neck and wet the towel.

It is an object of the present invention to provide an apparatus that provides the option of whether or not to allow a liquid from a cooling medium, e.g., melted ice or condensate from a cold pack, or to allow liquid from a heating medium, e.g., warm water, to wet a portion of the towel tube.

In reference to FIG. 1 through FIG. 5, apparatus 100 comprises holding tube 102. Holding tube 102 comprises at least first beverage compartment 104 configured to hold first beverage container 106 at first section 108 of holding tube 102, and second beverage compartment 110 configured to hold second beverage container 112 at second section 114 of holding tube 102. Holding tube 102 further comprises third compartment or cooling medium compartment 116 configured to hold a cooling medium 118 (not shown in FIG. 1 through FIG. 4). Cooling medium compartment 116 is positioned between first beverage compartment 104 and second beverage compartment 110. Cooling medium compartment 116 is separated from the beverage compartments by seams 130. The apparatus comprises water permeable membrane 120 located below underside 122 of cooling medium compartment 116.

Cooling medium compartment 116 comprises topside zipper 124 located on topside 126 of cooling medium compartment 116, and an underside zipper 128 located on underside 122 of cooling medium compartment 116. As shown in FIG. 1, when topside zipper 124 is zipped to the closed position, there is no access from outside holding tube 102 to a space defined by the cooling medium compartment 116.

Figure 2:
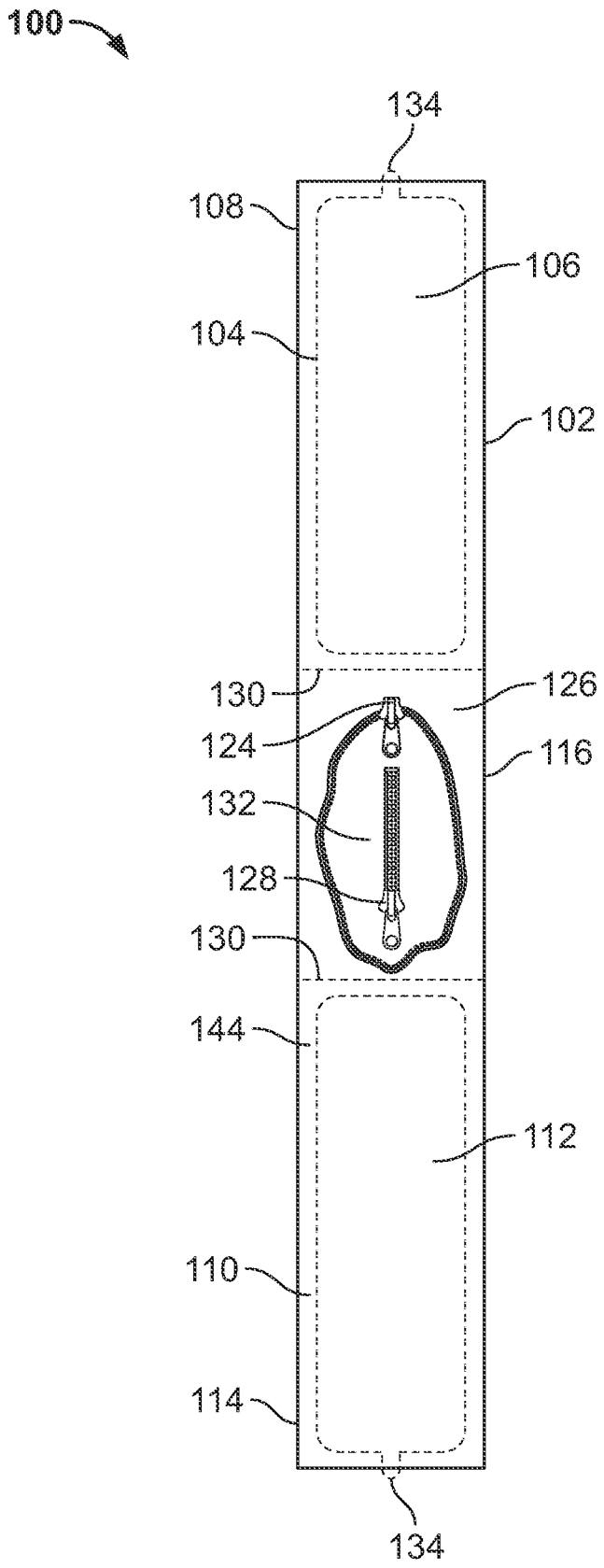
FIG. 2 is a semi-transparent top view showing the embodiment of FIG. 1, with the topside zipper in the open position, and the underside zipper in the closed position.

As shown in FIG. 2, when topside zipper 124 is unzipped to at least a partially open position, access is allowed from outside holding tube 102 to space 132 defined by cooling medium compartment 116. Topside zipper 124 allows a user to unzip topside zipper 124 to insert a cooling medium into cooling medium compartment 116, and then zip topside zipper 124 to prevent the cooling medium from leaving the cooling medium compartment through topside zipper 124.

A user can access underside zipper 128 when topside zipper 124 is unzipped to at least a partially open position as shown in FIG. 2. When underside zipper 128 is zipped to the closed position as shown in FIG. 2, there is no opening between cooling medium compartment 116 and permeable membrane 120.

Figure 3:
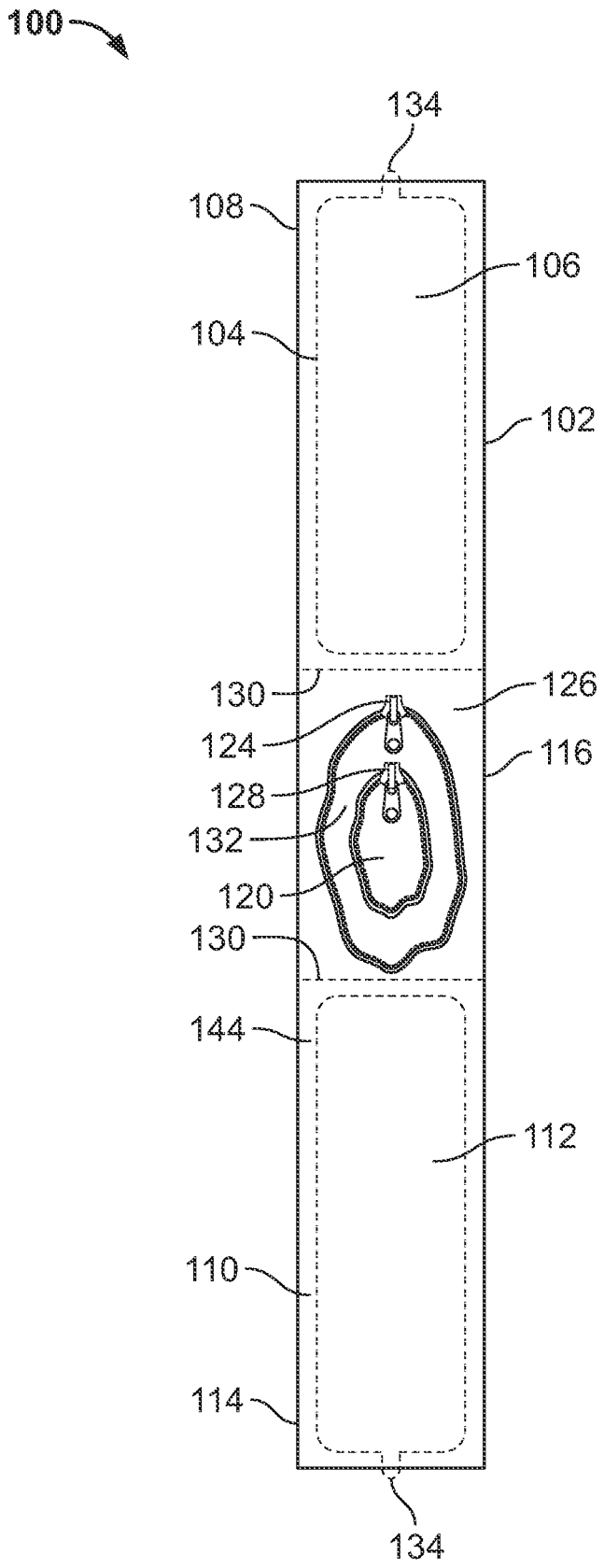
FIG. 3 is a semi-transparent top view showing of the embodiment of FIG. 1, with the topside zipper in the open position, and the underside zipper in the open position.

As shown in FIG. 3, when underside zipper 128 is unzipped to at least a partially open position, there is an opening between the cooling medium compartment 116 and permeable membrane 120 to allow water to move from cooling medium compartment 116 to permeable membrane 120. Permeable membrane 120 is configured to allow a cooling medium, e.g., water formed from the melting of ice or condensate from a cold pack in cooling medium compartment 116, to wet and permeate through permeable membrane 120. In an embodiment, holding tube 102 is made of a water repelling fabric, and permeable membrane 120 is made of a water permeable fabric. Preferably, these fabrics are comfortable to the skin of a user.

Figure 4:
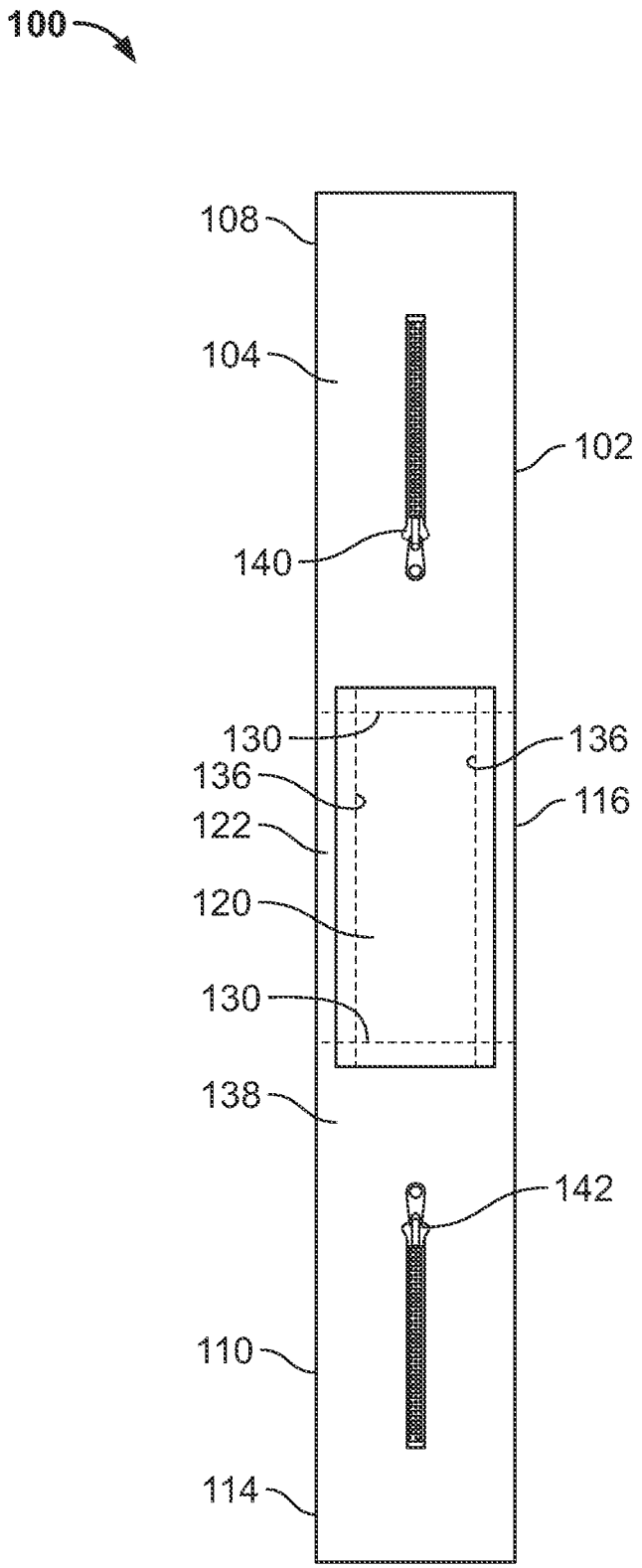
FIG. 4 is a bottom view showing the embodiment of FIG. 1.

As shown in FIG. 4, permeable membrane 120 may be sewn to underside 122 of cooling medium compartment 116 by longitudinal seams 136 and lateral seams, which may be lateral seams 130 that also separate compartment 116 from compartments 104 and 110. As shown in FIG. 4, in an embodiment, beverage compartment zippers 140 and 142 located on underside 138 of holding tube 102 provide access to the underside of first beverage compartment 104 and second beverage compartment 110, respectively. When opened, zippers 140 and 142 allow for first beverage container 106 and second beverage container 112 to be placed in first beverage compartment 104 and second beverage compartment 110 as shown in FIG. 1 through FIG. 4, respectively. In an alternative embodiment, first beverage compartment zipper 104 and second beverage compartment zipper 142 may be located on topside 144 of holding tube 102 as shown in FIG. 1 through FIG. 4.

Figure 5:
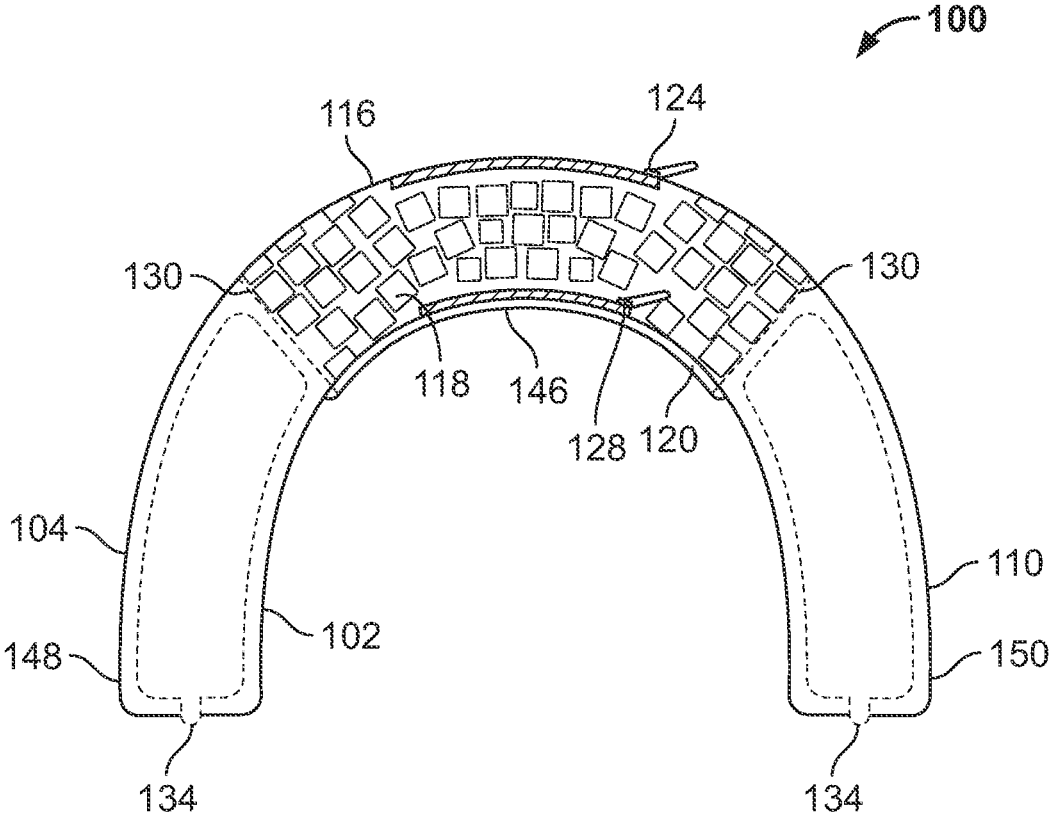
FIG. 5 is a semi-transparent front view of the embodiment of FIG. 1 in a U-shape configuration.

As shown in FIG. 5, holding tube 102 can form a U-shape with bite portion 146 and leg portions 148 and 150, wherein permeable membrane 120 can be placed on the back and sides of the neck and collarbone of a user, and first beverage compartment 104 and second beverage compartment 110 positioned to rest on the left and right front chest of the user. FIG. 5 shows cooling medium 118, which may comprise any suitable cooling medium, e.g., ice (such as ice cubes), water from melted ice, and/or a cold pack. Cooling medium 118 cools beverages in beverage containers 106 and 112, and can also cool the neck of a user. Cooling medium 118 within cooling medium compartment 116 is in contact with beverage containers 106 and 112 across a respective interface, which includes lateral seams 130. In an embodiment, when holding tube 102 is placed on the back and sides of the neck and collarbone of a user, first beverage compartment zipper 140 and second beverage compartment zipper 142 (as shown in FIG. 4) are on the backside of holding tube 102 facing the chest of the user, and are thus not accessible from the front of holding tube 102 facing opposite the chest of the user.

If desired, apparatus 100 can be worn by a user. The user can opt to unzip underside zipper 128 to allow water from cooling medium compartment 116 to wet and permeate through permeable membrane 120 to cool the back and sides of the user's neck and/or the user's collarbone to provide even more cooling than when water is not allowed wet and permeate through permeable membrane 120.

Figure 6:
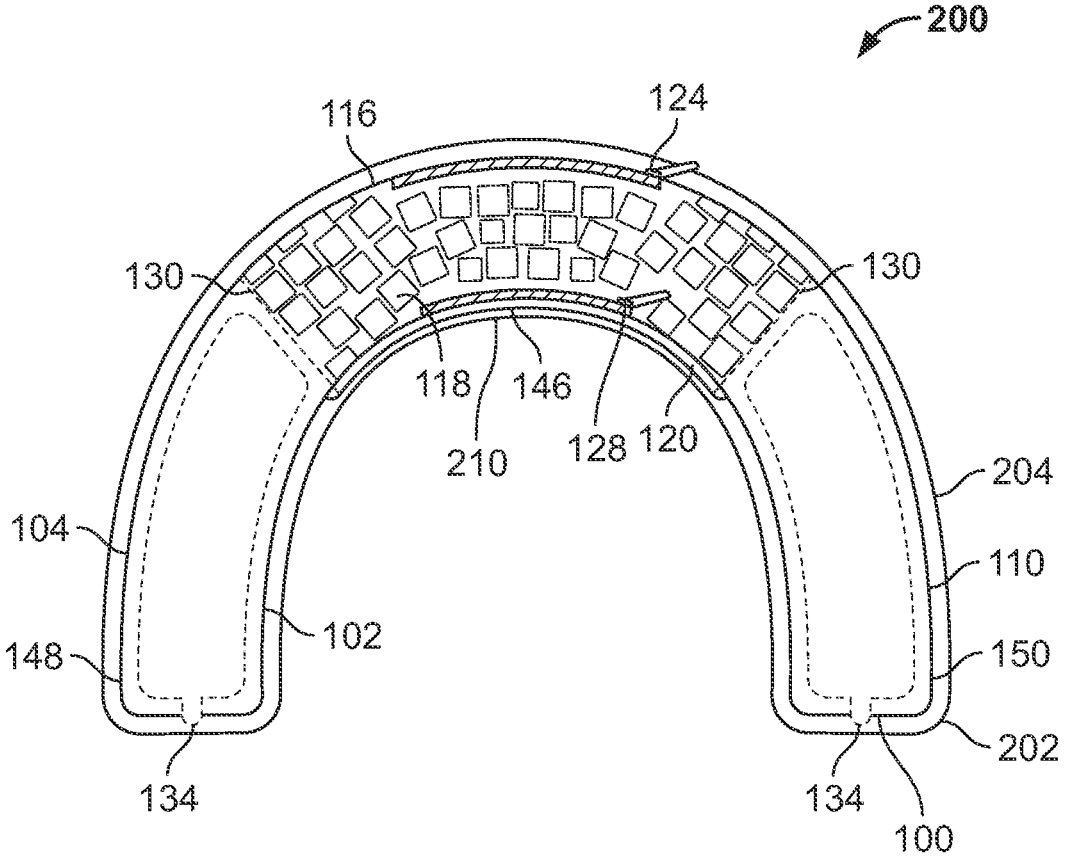
FIG. 6 is a semi-transparent front view of an embodiment according to the invention, wherein the embodiment is U-shape combination of a towel tube and the embodiment shown an FIG. 1.

In the embodiment shown in FIG. 6, apparatus 200 comprises towel tube 202 in combination with apparatus 100 shown in FIG. 1 through FIG. 5. As shown in FIG. 6, holding tube 102 and permeable membrane 120 are located within towel tube 202. Towel tube 202 is water absorbent. Towel tube 202 comprises towel 204 having lateral sides and longitudinal sides, wherein the longitudinal sides are joined together. In an embodiment, the longitudinal sides are sewn or stitched together by a longitudinal seam, or attached by snaps, buttons, or hooks and loops. In this embodiment, towel tube 202 may fastened to holding tube 102 (e.g., by stitching), and together can form a U-shape, wherein bite portion 210 of the U-shape has the cooling membrane compartment 116 and permeable membrane 120 located therein. Bite portion 210 of the U-shape can be placed on the back and sides of the neck and/or collarbone of a user, and first beverage compartment 104 and second beverage compartment 110 are positioned to rest on the left and right front chest or torso of the user. When underside zipper 128 is in at least a partially open position, water from cooling medium 118, including, e.g., water formed from the melting of ice or condensate from a cold pack in the cooling medium compartment 116 is allowed to wet and permeate through permeable membrane 120, and then wet the bite portion 210 of the U-shape towel tube 202 resting on the back and sides of the user's neck and/or the user's collarbone.

In a preferred embodiment, holding tube 102 comprises nylon. In a preferred embodiment, water permeable membrane comprises a clothing or towel fabric.

In an embodiment, the holding tube has similar dimensions as a towel tube. The towel tube may be a typical towel that is about forty-two (42) inches long and about twenty-two (22) inches wide. Thus, the holding tube may be about forty-two (42) inches long and about twenty-two (22) inches wide.

In an embodiment, the length of the cooling medium compartment is about ten (10) inches, wherein seams forming the cooling medium compartment are about ten (10) inches apart. Thus, when the holding tube is about forty-two (42) inches long, the first and second beverage compartments are each about sixteen (16) inches in length.

In an embodiment, the cooling medium compartment can hold at least three cups of ice.

In an embodiment, the underside zipper is configured to be unzipped to allow a cold pack to be placed in a pouch formed by the permeable membrane.

In an embodiment, the first and second beverage compartments each have a beverage compartment zipper that can be unzipped to provide an opening so the first and second beverage compartments can receive a first beverage container and a second beverage container, respectively. Each beverage compartment zipper can be zipped closed to maintain the respective beverage container in the respective beverage compartment.

In an embodiment, each beverage compartment zipper and the topside zipper are located along the same linear towel seam, and a narrow flap of the towel tube covers view of the zippers. In an alternative embodiment, the topside zipper is located along the same linear towel seam, and a narrow flap of the towel covers the view of the topside zipper, and each beverage compartment zipper is located longitudinally on underside 138 of the holding tube 102, and are accessible through a respective stitched slit in the towel.

In an embodiment, the apparatus is clothes washing machine compatible.

In an embodiment, the first and second beverage compartments can each have an opening configured to allow a port or drink stem 134 of a beverage container to exit a lateral seam opposite the lateral seam 130 that separates the beverage compartment from the cooling medium compartment. In an embodiment, the port or drink stem 134 can be easily accessed by moving the port or drink stem to the lips of a user. In an embodiment, the towel tube covers the front view of the port or drink stem so that the port or drink stem is not visible looking at the front of the towel tube when apparatus worn around the neck of a user as described above.

In an embodiment, each beverage container may be a bladder or bag that holds at least eight (8) ounces of a beverage.

In an embodiment, apparatus 200 may be used as golf towel.

In an embodiment, a hot pack or heat pack may be placed in the pouch formed by the permeable membrane when it is desired to warm the neck of a user.

Figure 7:
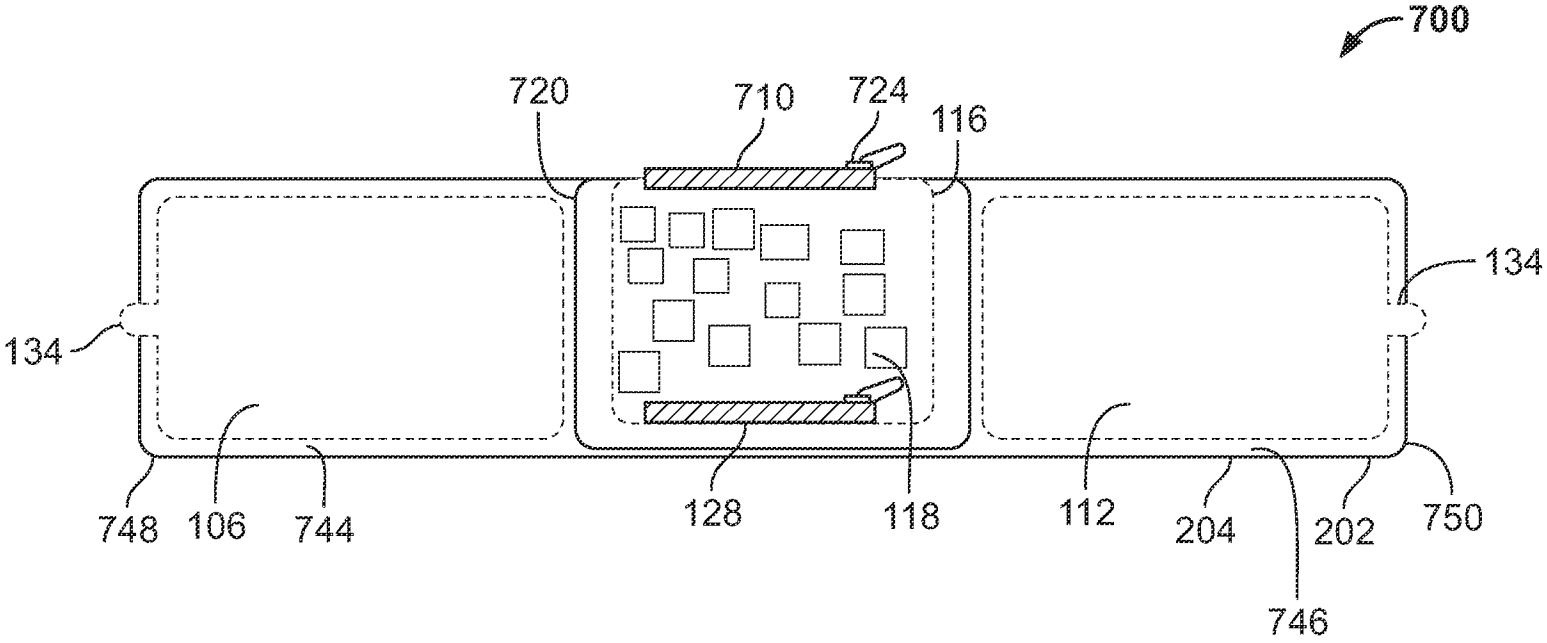
FIG. 7 is a semi-transparent front view of an alternative embodiment according to the invention, wherein the apparatus comprises a water permeable membrane bag that shares the top zipper with the towel tube at the bite or middle portion of the towel tube.
Figure 8:
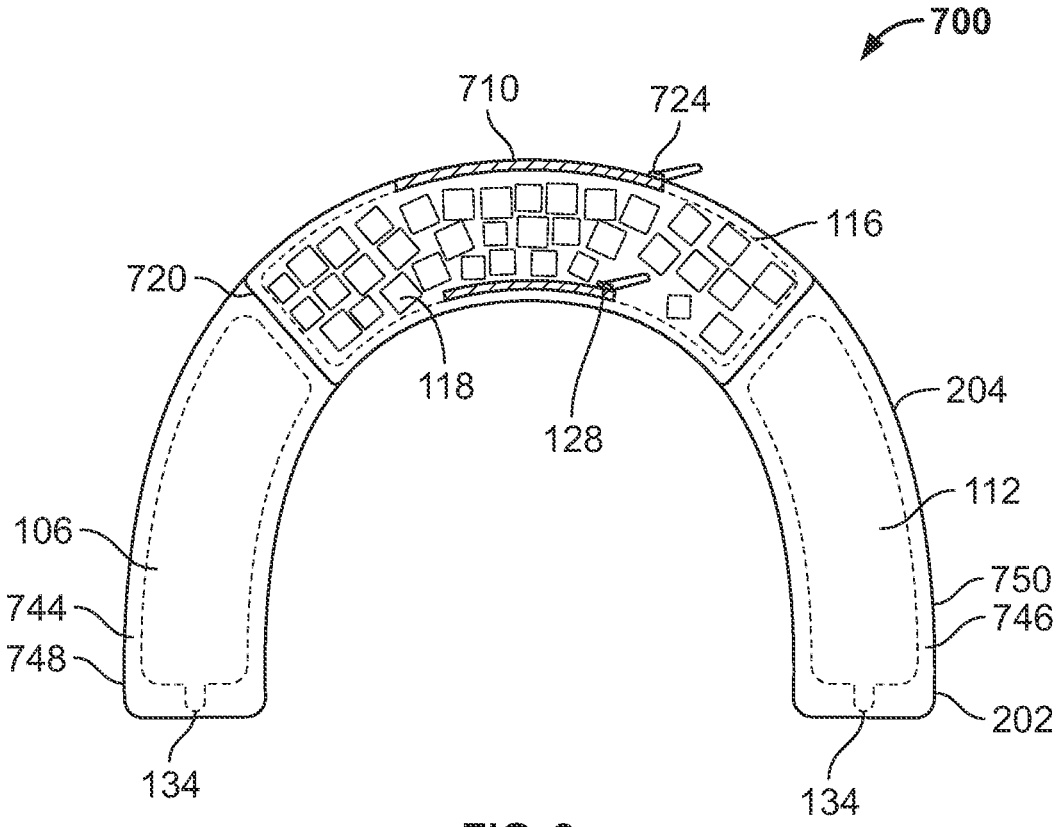
FIG. 8 shows the embodiment of FIG. 7, wherein the embodiment is formed in a U-shape.

An alternative embodiment is shown in FIGS. 7 and 8. As shown in FIGS. 7 and 8, towel tube 202 has first topside zipper 724 at the bite or middle portion 710 of towel tube 202. As shown in FIGS. 7-8, the water permeable membrane is a tube or bag 720 that shares outside or topside zipper 724 with towel tube 202 at the bite or middle portion 710 of towel tube 202. Permeable membrane bag 720 may have, however, a second topside zipper (not shown) that is separate from first topside zipper 724 of towel tube 202. Permeable membrane bag 720 may be affixed to towel tube 202, for example by stitching (not shown) at or near topside zipper 724, or by snaps, buttons or hooks and loops (e.g., Velcro®). Topside zipper 724 may be affixed to towel 204 before towel 204 is rolled to form towel tube 202. The longitudinal sides of towel 204 may be fastened to each other, for example by stitching, snaps, buttons or hooks and loops (e.g., Velcro®).

In the embodiment shown in FIGS. 7 and 8, apparatus 700 comprises cooling medium compartment 116 that is within permeable membrane bag 720, the combination of which may be characterized as a "bag within a bag" 706. In this embodiment, when underside zipper 128 is at least partially unzipped, water from cooling medium compartment 116 can wet and permeate through the permeable membrane bag 720 to cool the user's neck and wet the towel. As shown in FIGS. 7 and 8, cooling medium compartment 116 may share topside zipper 724 with permeable membrane bag 720 and towel tube 202. Cooling medium compartment 116 may have, however, a third topside zipper (not shown) that is separate from first topside zipper 724 of towel tube 202, and second topside zipper (not shown) of water permeable membrane bag 720. The topside zipper of the cooling medium compartment may be separate from top zipper 724 of towel tube 202, but share the second topside zipper of permeable membrane bag 720. In this embodiment, there is no holding tube 102 and there are no seams 130 as shown in FIGS. 1-6. In the embodiment shown in FIGS. 7 and 8, towel tube 202 may comprise first and second side zippers (not shown) to allow access so first beverage container 106 can be placed within first beverage container compartment 744 of towel tube 202 at first section or leg 748 of towel tube 202, and second beverage container 112 can be placed within second beverage container compartment 746 of towel tube 202 at second section or leg 750 of towel tube 202. Permeable membrane 720 may be in contact with beverage containers 106 and 112. With the exception of the foregoing, this embodiment is the same or substantially the same as the structure shown in FIGS. 1-6.

Aspects of the invention relate to a wearable device that can provide cooling or heat to beverages while also providing cooling or heat to the neck of a user. In an aspect, the invention relates to providing a user the option of whether or not to cool the back and sides of the user's neck and/or the user's collarbone with a cooling medium placed in the apparatus that wets a water permeable portion of the apparatus that is in contact with the neck and/or collarbone of the user. Those having skill in the art, with knowledge gained from the present disclosure, will recognize that various changes can be made to the applications and associated components as described herein, in attaining these and other advantages without departing from the scope of the present disclosure.

What is claimed is:

1. An apparatus comprising:

a first fabric layer and a second fabric layer, wherein the first fabric layer has an elongated rectangular section aligned with an elongated rectangular section of the second fabric layer, wherein the elongated rectangular section of the first fabric layer is stitched to the elongated rectangular section of second fabric layer at one or more periphery seams at or near the respective peripheries of each fabric layer, wherein the first fabric layer and second fabric layer has corresponding first and second end portions, and corresponding middle portions;

a water-permeable compartment located between the elongated rectangular section of the first fabric layer and the elongated rectangular section of the second fabric layer at the middle portion of the first fabric layer and the corresponding middle portion of the second fabric layer, wherein the water-permeable compartment has an elongated rectangular topside section and an elongated rectangular underside section, each having a length that is less than the length of the elongated rectangular sections of the first and second fabric layers;

wherein the elongated rectangular topside section and the elongated rectangular underside section of the water-permeable compartment are stitched together at one or more periphery seams at or near the respective peripheries of the elongated rectangular topside section and the elongated rectangular underside section of the water-permeable compartment;

wherein the one or more periphery seams of the water-permeable compartment coincide with or are the same as the one or more periphery seams of the first fabric layer and the second fabric layer;

wherein the second fabric layer and water-permeable compartment collectively define an opening at the middle portion of the second fabric layer;

wherein the opening is configured to receive a cooling medium or a heating medium and the water-permeable compartment is configured to receive a cooling medium or heating medium via the opening;

wherein when at least a part of the middle portion of the second fabric layer is placed on a portion of the neck of a user, the opening is not accessible, and wherein when a cooling medium or heating medium is placed in the water-permeable compartment the medium will cool or warm the part placed on the portion of the neck of the user and at least a part of the middle portion of the first fabric layer will extend out and away from the at least a part of the middle portion of the second fabric layer placed on the portion of the neck of the user;

wherein the water-permeable compartment is substantially centered between the first and second end portions of the first fabric layer and the second fabric layer.

2. The apparatus of claim 1, wherein the water-permeable compartment comprises a different material than the first fabric layer and the second fabric layer.

3. The apparatus of claim 1 wherein the first fabric layer and the second fabric layer comprise the same material.

4. The apparatus of claim 1, wherein the first fabric layer comprises a material selected from the group consisting of cotton, synthetic material, and combinations thereof.

5. The apparatus of claim 4, wherein the first fabric layer comprises a material having a weave selected from the group consisting of terry, waffle, gauze, damask, herringbone, and combinations thereof.

6. The apparatus of claim 4, wherein the synthetic material is a microfiber.

7. The apparatus of claim 1, wherein the second fabric layer comprises a material selected from the group consisting of cotton, a synthetic material, and combinations thereof.

8. The apparatus of claim 7, wherein the second fabric layer comprises a material having a weave selected from the group consisting of terry, waffle, gauze, damask, herringbone, and combinations thereof.

9. The apparatus of claim 7, wherein the synthetic material is a microfiber.

10. The apparatus of claim 1, wherein the water-permeable compartment comprises material selected from the group consisting of nylon, rayon, polyester, and combinations thereof.

11. The apparatus of claim 1, wherein the opening is a slot that extends along a width of the elongated rectangular section of the second fabric layer.

12. The apparatus of claim 11, wherein the slot is perpendicular or substantially perpendicular to the length of the elongated rectangular section of the second fabric layer.

13. The apparatus of claim 11, wherein the slot has a first edge and second edge, wherein the first edge extends over the second edge.

14. The apparatus of claim 1, further comprising a cooling medium, wherein the cooling medium comprises water having a temperature less than ambient air and is selected from the group comprising ice, cold water, cooled water, condensation from a container filled with ice, condensation from a cold pack, and combinations thereof.

15. The apparatus of claim 14, wherein when the cooling medium is placed into the water-permeable compartment, liquid water will wet the part of the middle portion of the second fabric layer in contact with the neck portion of a user.

16. The apparatus of claim 14, wherein when the cooling medium is in a resealable container, the opening defined by the second fabric layer and the water-permeable compartment are each configured to receive the resealable container.

17. The apparatus of claim 16, wherein when the seal of the resealable container is opened at least partially, liquid water from the container will wet the water-permeable compartment and wet the part of the middle portion of the second fabric layer in contact with the neck portion of a user.

18. The apparatus of claim 1, further comprising a cooling medium or a heating medium, wherein the cooling medium or heating medium is maintained in a bendable strip of material and the opening defined by the second fabric layer and the water-permeable compartment are each configured to receive the bendable strip of material.

19. The apparatus of claim 1, wherein the water permeable compartment has a length that is 20 to 40% less than the length of the elongated rectangular section of second fabric layer.

20. The apparatus of claim 19, wherein the water permeable compartment has a length that is 25 to 35% less than the length of the elongated rectangular section of second fabric layer.

21. The apparatus of claim 1, wherein the water-permeable compartment has less water permeability than the water permeability of the second fabric layer.

22. The apparatus of claim 1, wherein the water-permeable compartment is centered between the first and second end portions of the first fabric layer and the second fabric layer.

* * * * *